US011878226B2

(12) United States Patent
Čupa

(10) Patent No.: US 11,878,226 B2
(45) Date of Patent: Jan. 23, 2024

(54) HIGH-SPEED SKATEMILL WITH A MOVABLE SKATEMILL BELT

(71) Applicant: HDTS, A.S., Stupava (SK)

(72) Inventor: Pavol Čupa, Lozorno (SK)

(73) Assignee: HDTS, A.S.

( * ) Notice: Subject to any disclaimer, the term of this patent is extended or adjusted under 35 U.S.C. 154(b) by 156 days.

(21) Appl. No.: 17/413,998

(22) PCT Filed: Dec. 21, 2018

(86) PCT No.: PCT/SK2018/050018
§ 371 (c)(1),
(2) Date: Jun. 15, 2021

(87) PCT Pub. No.: WO2020/130951
PCT Pub. Date: Jun. 25, 2020

(65) Prior Publication Data

US 2022/0111278 A1 Apr. 14, 2022

(30) Foreign Application Priority Data

Dec. 17, 2018 (SK) ..... 228-2018 U
Dec. 19, 2018 (SK) ..... 234-2018 U

(51) Int. Cl.
*A63B 69/00* (2006.01)
*A63B 22/02* (2006.01)
(Continued)

(52) U.S. Cl.
CPC ..... *A63B 69/0022* (2013.01); *A63B 22/02* (2013.01); *A63B 22/0242* (2013.01);
(Continued)

(58) Field of Classification Search
CPC .... A63B 2022/0271; A63B 2022/0278; A63B 22/0207; A63B 22/0214; A63B 22/0221;
(Continued)

(56) References Cited

U.S. PATENT DOCUMENTS 3,711,090 A * 1/1973 Fiedler ..... A63B 22/0292 198/321
3,941,377 A * 3/1976 Lie ..... A63B 69/182 482/54
(Continued)

FOREIGN PATENT DOCUMENTS

CA 2 672 558 A1 6/2010
CN 104461018 A * 3/2015 ..... A63B 22/02
(Continued)

OTHER PUBLICATIONS

CN-104461018-A_translate (Year: 2015).*
(Continued)

*Primary Examiner* — Megan Anderson
(74) *Attorney, Agent, or Firm* — OSTROLENK FABER LLP

(57) ABSTRACT

A high-speed skatemill with a movable skatemill belt that includes a movable skatemill belt mounted on the rotating drums and where the working area of the movable skatemill belt is supported by stationary rigid sliding pads with integrated distribution channels for distributing a compressed gas or gas mixtures into the injection openings or slits. The compressed gas or the compressed gas mixture optionally enriched with an anti-friction medium in the form of a vapor or aerosol or dispersion containing solid dust particles or solid microparticles is injected through the inlet openings. By means of the anti-friction applicator, the anti-friction medium is applied to the movable skatemill belt, which then transports the medium to the points of contact with the fixed rigid sliding pads. Stationary solid sliding pads can be cooled down by liquid and/or gaseous cooling medium circulating by default in the hollow support beams of the stationary solid sliding pads.

15 Claims, 7 Drawing Sheets

Figure 1A:
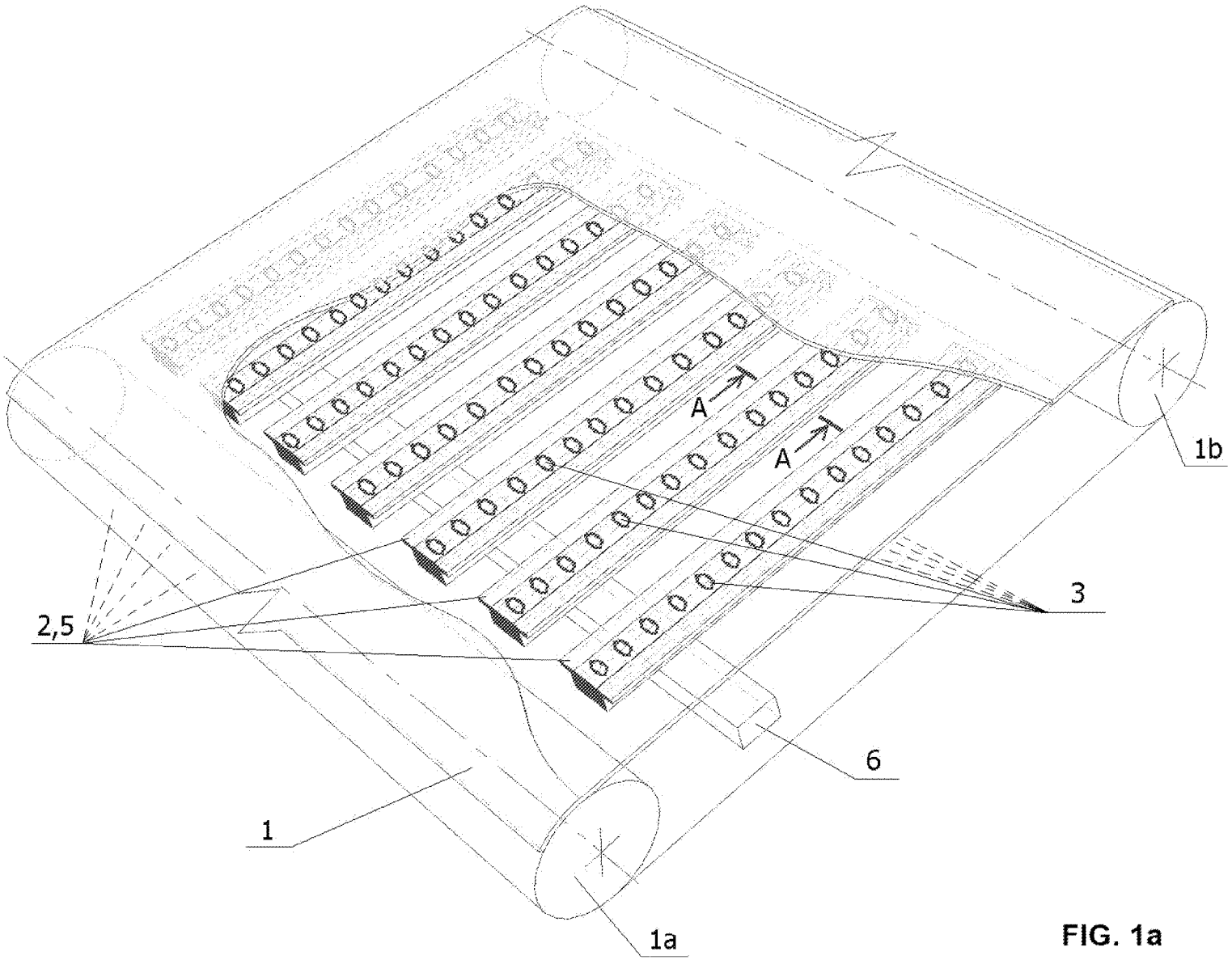

(51) Int. Cl.
*A63B 71/02* (2006.01)
*A63B 102/24* (2015.01)

(52) U.S. Cl.
CPC ..... *A63B 22/0285* (2013.01); *A63B 2071/025* (2013.01); *A63B 2102/24* (2015.10); *A63B 2209/00* (2013.01); *A63B 2225/66* (2013.01); *A63B 2244/18* (2013.01)

(58) Field of Classification Search
CPC . A63B 22/0228; A63B 22/02; A63B 22/0242; A63B 22/0235; A63B 22/025; A63B 22/0257; A63B 22/0264; A63B 69/0022; A63B 24/0062; A63B 24/0075; A63B 24/0084; A63B 24/0087; A63B 2225/30; A63B 2071/025; A63B 2244/18; A63B 2102/24; A63B 22/264; A63B 22/0285; A63B 22/0292; A63B 69/0024; A63B 69/0026; A63B 2209/00; A63B 2225/066
USPC ..... 473/446; 482/51
See application file for complete search history.

(56) References Cited

U.S. PATENT DOCUMENTS 4,350,336 A * 9/1982 Hanford ..... A63B 22/02 198/841
4,616,822 A * 10/1986 Trulaske ..... A63B 22/02 198/841
5,052,682 A * 10/1991 Croce, Jr. ..... A63B 69/0022 472/90
5,385,520 A * 1/1995 Lepine ..... A63B 22/0023 482/54
5,439,215 A * 8/1995 Ratchford ..... A63B 60/08 473/561
5,924,960 A * 7/1999 Cohen ..... A63B 21/00047 482/42
5,993,358 A * 11/1999 Gureghian ..... A63B 22/02 482/54
6,231,482 B1 * 5/2001 Thompson ..... A63B 24/00 482/37
2009/0023554 A1 * 1/2009 Shim ..... A63B 22/02 482/4
2010/0035726 A1 * 2/2010 Fisher ..... A63B 24/0084 482/8
2018/0001173 A1 1/2018 Cupa
2018/0036585 A1 * 2/2018 Powell ..... A63B 22/025
2020/0368575 A1 * 11/2020 Hays ..... H02K 5/207

FOREIGN PATENT DOCUMENTS

RU 2 643 640 C1 2/2018
SK 8220 Y1 9/2018
WO WO-2005039036 A2 * 4/2005 ..... A63B 22/02

OTHER PUBLICATIONS

International Search Report dated Oct. 24, 2019 in corresponding PCT International Application No. PCT/SK2018/050018.
Written Opinion dated Oct. 24, 2019 in corresponding PCT International Application No. PCT/SK2018/050018.

* cited by examiner

HIGH-SPEED SKATEMILL WITH A MOVABLE SKATEMILL BELT

CROSS-REFERENCE TO RELATED APPLICATIONS

The present application is a 35 U.S.C. §§ 371 national phase conversion of PCT/SK2018/050018, filed Dec. 21, 2018, which claims priority to Slovakia Patent Application Nos. PUV 228-2018 and PUV 234-2018, filed Dec. 17, 2018 and Dec. 19, 2018, respectively, the contents of which are incorporated herein by reference. The PCT International Application was published in the English language.

TECHNICAL FIELD OF INVENTION

The invention relates to a high-speed skatemill with a movable skatemill belt that may reach velocity higher than 10 m/s. The invention falls into the field of sports training and testing devices.

BACKGROUND OF THE INVENTION

As for the present skatemill solutions with a movable skatemill belt aimed at skating skills practice, there are two prevailing ways how to mount the movable skatemill belt. In one case it is a rolling fit of the skatemill belt on the pivotal elements, e.g. rollers that form the so-called roller track in the area beneath the working surface of the skatemill belt. In the other scenario it is a sliding fit of the skatemill belt on the stationary support slides that support the skating surface of the skatemill belt. In the latter case, which is more advantageous for the skating practice, however, the magnitude of friction between the inner plastic layer of the movable skatemill belt and the stationary support slides limits the maximum speed of skatemill belt to less than 10 m/s. When the skatemill belt moves at a speed greater than 10 m/s, due to high friction, the inner plastic layer of the movable skatemill belt gets thermally overloaded, which in the best case will reduce the life of the skatemill belt or worse, it will result in its immediate destruction.

U.S. Pat. No. 5,385,520 discloses a complete ice skating treadmill principle featuring a support base with a longitudinally tilting skatemill surface whose positive or negative incline can be adjusted by means of a lifting device employing two electrically driven threaded rods. The skating area consists of a platform fitted with two drive and tension roller drums that carry an endless belt covered with ridged slats of plastic. Furthermore, there is a support roller track supporting the belt and an electric motor with an electric distributor containing a drive inverter and other necessary electrical components, as well as a control panel with belt speed and incline indicators and controls for Start, Stop, Tilt etc. The construction includes: a rubberized polyester core strip, sliding strips made of the so-called hardened polyethylene fastened to the belt by means of dovetail tabs and a transverse handle on the front of the skating area.

In addition, the state of the art is documented, for instance, in the patent application RU 2643640 C1 and the Slovak utility model UV 8220 SK, which describe an integrated multipurpose hockey skatemill and a method of controlling it for individual training and testing of skating and ice hockey skills. The said skatemill consists of stationary and moving areas made of artificial ice. The movable area of artificial ice of the skatemill is formed by a skatemill belt, which is slidably mounted on metal beams supporting the work surface of the skatemill belt. However, this construction of metal beams that support the surface of the skatemill belt does not allow to perform training and testing of skating skills at speeds higher than 10 m/s.

With regard to the integrated multi-purpose ice hockey skatemill, as described in the patent RU 2643640 C1 and (in) the Slovak utility model UV 8220 SK, there is a limitation as to the time of continuous operation of its skatemill belt depending on the load of the skatemill belt exerted by the weight of a skater or hockey player, limited to maximum of tens of minutes, as during the longer operation, thermal overload of the inner plastic layer on the skatemill belt occurs that leads in better case to lower lifetime of the skatemill belt or its immediate destruction.

Due to the deficiency of the existing skatemills featuring a movable skatemill belt that is mounted slidably on stationary bearing slides supporting the work surface of the skatemill belt, a design of a high-speed skatemill with a movable skatemill belt has been created in order to enable skaters to practice and test their skating skills at speeds over 10 m/s with no time limitations. The skatemill is described in the submitted invention.

SUMMARY OF THE INVENTION

The above-mentioned drawbacks are overcome by the solution of a high-speed skatemill with a movable skatemill belt. The movable skatemill belt is mounted on two rotating support drums, which are fitted to a common support frame by means of rolling-element bearings. At least one of the support drums is driven by a drive unit. Any kind of drive unit can be used to drive the skatemill belt whose direction and speed of rotation can be smoothly steered. The movable skatemill belt can perform a direct sliding movement in both directions.

In the work area, i.e. in the area of the movable skatemill belt designed for skating training, the movable skatemill belt is supported by the stationary rigid sliding pads, on which the inner side of the skatemill belt slides. Supporting the movable skatemill belt with a rigid support structure, i.e. rigid sliding pads, ensures that the stiffness of the movable skatemill belt does not differ significantly from the stiffness of the actual ice surface, which contributes to the realistic skating training on the high-speed skatemill.

Summary of the invention rests in the fact that the movable skatemill belt is mounted in such a way that its inner upper side is slidably fitted to such fixed rigid sliding pads that contain at least one injection opening in order to reduce undesirable friction and/or at least one gas injection slot directed toward the inner side of the movable skatemill belt and/or comprises at least one applicator with an anti-friction fluid outlet in at least one gaseous and/or liquid and/or solid state directed towards the inner side of the movable skatemill belt. Apparently, a set of grooves, which may come in the form of classic holes or continuous grooves, is to be used. In a simplified version, the injection openings and/or the slit of the fixed rigid slide are connected directly to at least one gas (mixture) inlet, and air is also taken into consideration. In a more sophisticated version, the injection openings and/or the slit of the fixed rigid slide are connected through a distribution channel with at least one gas (mixture), and air is also taken into account.

The injection openings and slits make it possible to inject compressed gas, i.e. compressed gas or another gaseous medium with a low dynamic viscosity, into the contact zone between the non-moving rigid slide pads and the movable skatemill belt, thus creating in the area so-called gas bearings, i.e. a layer with significantly lower friction than would be in contact with the movable skatemill belt and the non-moving slide pads if the compressed gas was not to be injected into the contact zone. The gas bearings thus reduce the friction occurring when the movable skatemill belt moves over the fixed rigid slides, thereby reducing the thermal exposure of the movable skatemill belt's material at the points of its contact with the stationary rigid slides. This makes it possible to increase the running speed of the movable skatemill belt above the level of 10 m/s or, rather, to use a drive unit (with advantage to use a 3-phase electric motor) with lower power to drive the skatemill belt.

If there is a need for further reduction of friction between the movable skatemill belt and the stationary rigid slide pads, a solid anti-friction medium is applied to the surface of the movable skatemill belt which is in contact with the stationary rigid slides. The anti-friction medium may come as a powder or in the form of solid particles in the dispersion, or the medium may be applied to the surface of the skatemill belt by coating with a monolithic block of anti-friction material or by transferring the anti-friction medium to the skatemill belt's surface by means of sublimation. Alternatively, a liquid anti-friction medium may be applied to the surface of the movable skatemill belt either directly in liquid form, in the form of an aerosol or vapor, or an anti-friction medium in the form of a plastic lubricant may be applied to the surface of the skatemill belt. There is also a constructional possibility where, in order to reduce the undesired friction, the outlet of the anti-friction media applicator is directed towards the inside of the movable skatemill belt through the inlet openings of the pressurized gas or gas mixtures. The injection openings and slits are then the outlet for liquid or aerosol or dispersion vapors containing solid dust particles or solid microparticles.

Further construction modification of the stationary solid sliding pads allows to lower their temperature, including the temperature of the sliding surfaces that are in contact with the skatemill belt, by means of a cooling medium (which can be liquid or gaseous) that is by default circulating in the hollows made for this purpose in the sliding pads. Such a modification makes it possible to decrease or regulate the working temperature of the sliding surfaces of the stationary solid sliding pads that are in contact with the skatemill belt's surface even in the case of continuous (unlimited) motion of the skatemill belt at any speed of the working range of the skatemill.

OVERVIEW OF DRAWINGS

The basic arrangement of the design elements of the high-speed skatemill with the movable skatemill belt according to the invention is explained in more detail in the enclosed drawings, in which FIG. 1*a* represents the assembly of a movable skatemill belt supported in the work area by stationary rigid slides with injection openings.

Figure 1B:
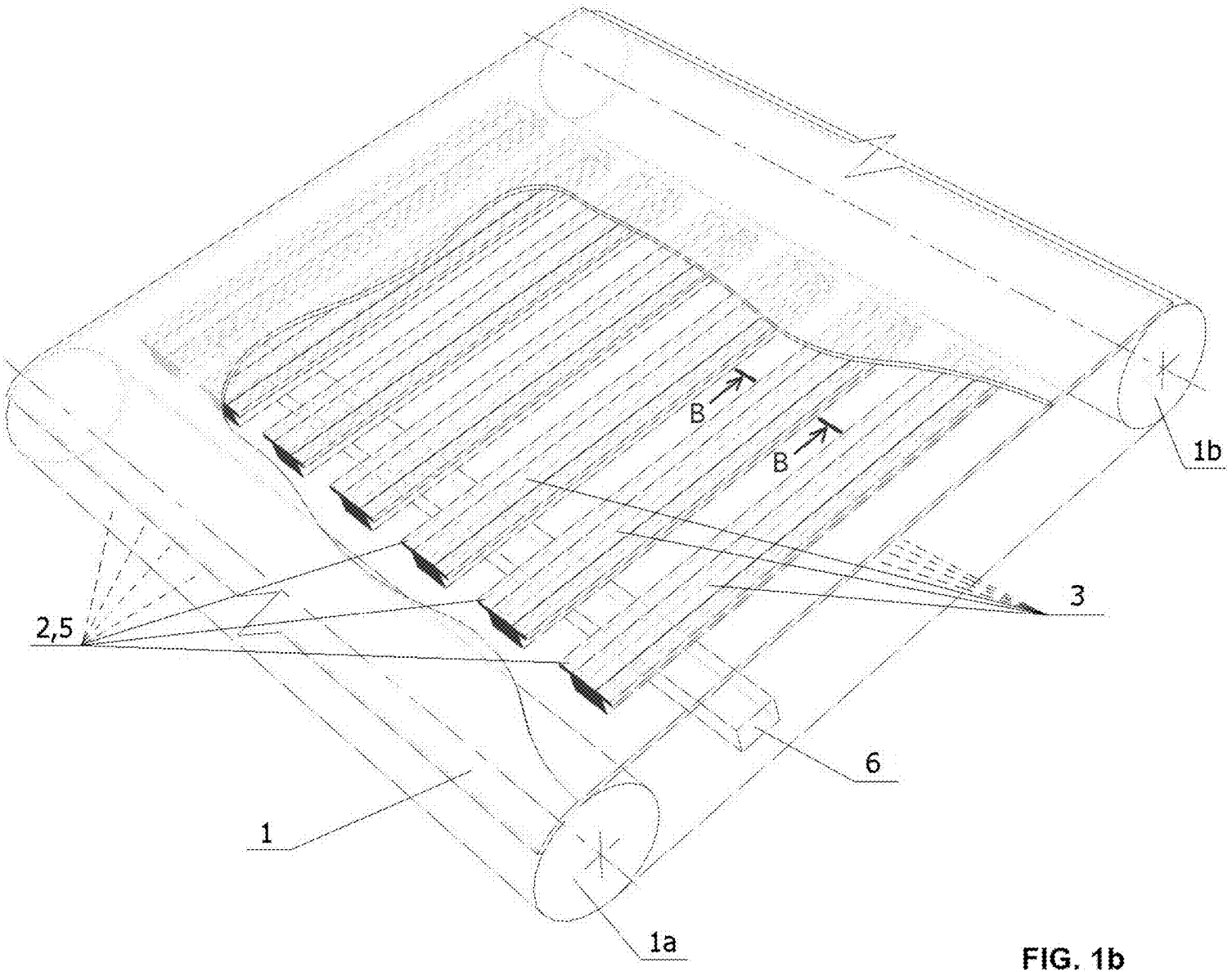

FIG. 1*b* represents the assembly of a movable skatemill belt supported in the work area by stationary rigid slides with injection openings formed by continuous grooves.

FIG. 2*a* shows an arrangement of inlet openings for injecting compressed gas into rigid slides with integrated distribution channels, and a solution for the drive of the skatemill belt's drive drum using a drum electric motor.

FIGS. 2*b* and 2*c* illustrate two other possible arrangements of the movable skatemill belt's drive.

Figure 3:
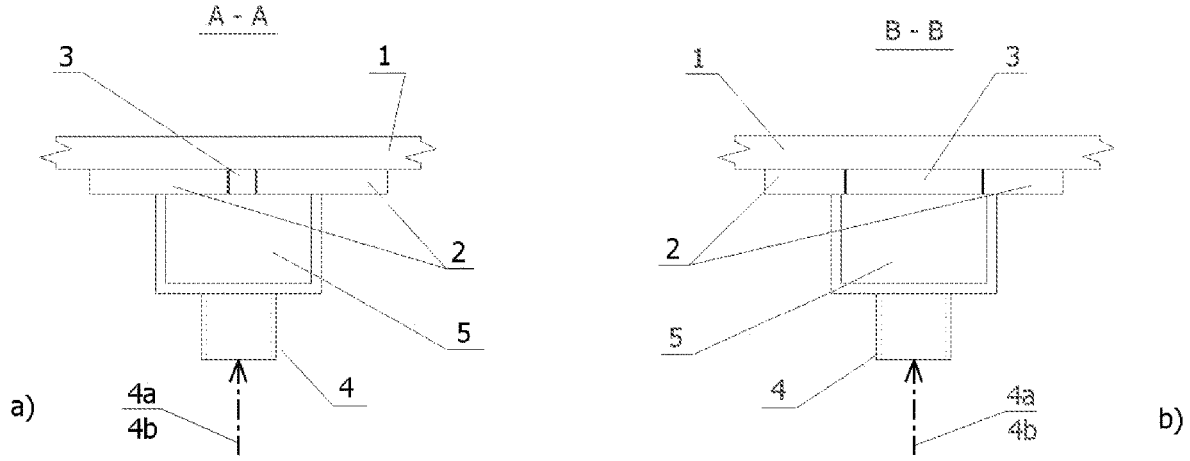

FIG. 3*a* shows an arrangement of inlet openings of compressed gas and distribution channels serving for the distribution of the compressed gas into the injection openings.

FIG. 3*b* shows an arrangement of inlet openings of the compressed gas and distribution channels serving for the distribution of the compressed gas or air to the injection openings formed by continuous grooves.

Figure 4:
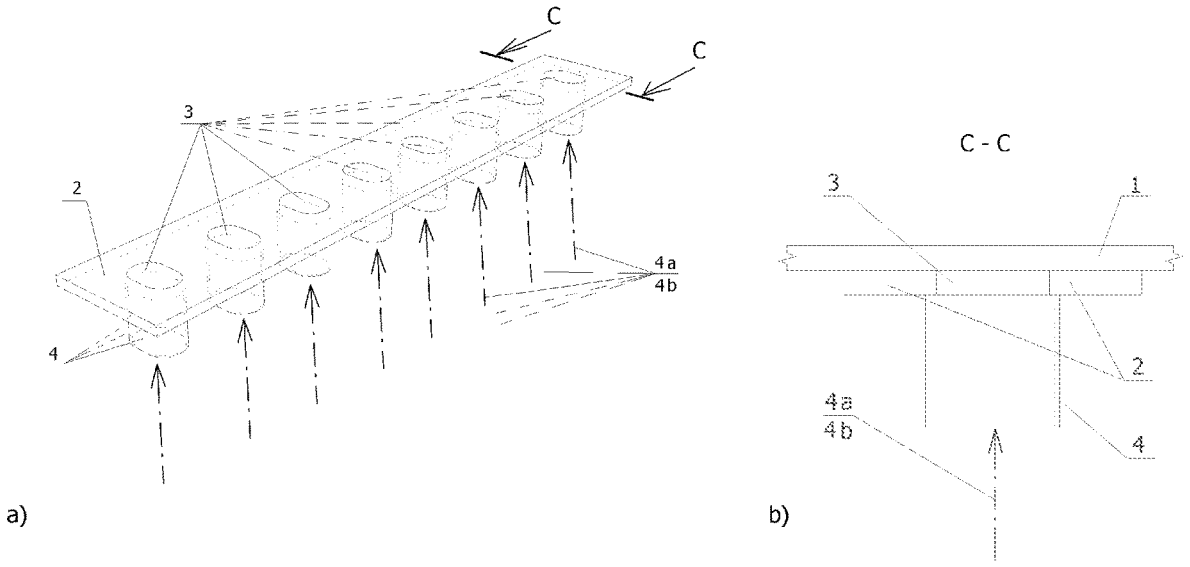

FIGS. 4*a* and 4*b* show an arrangement of inlet openings allowing direct injection of compressed gas into the injection openings without the need for a distribution channel.

Figure 5:
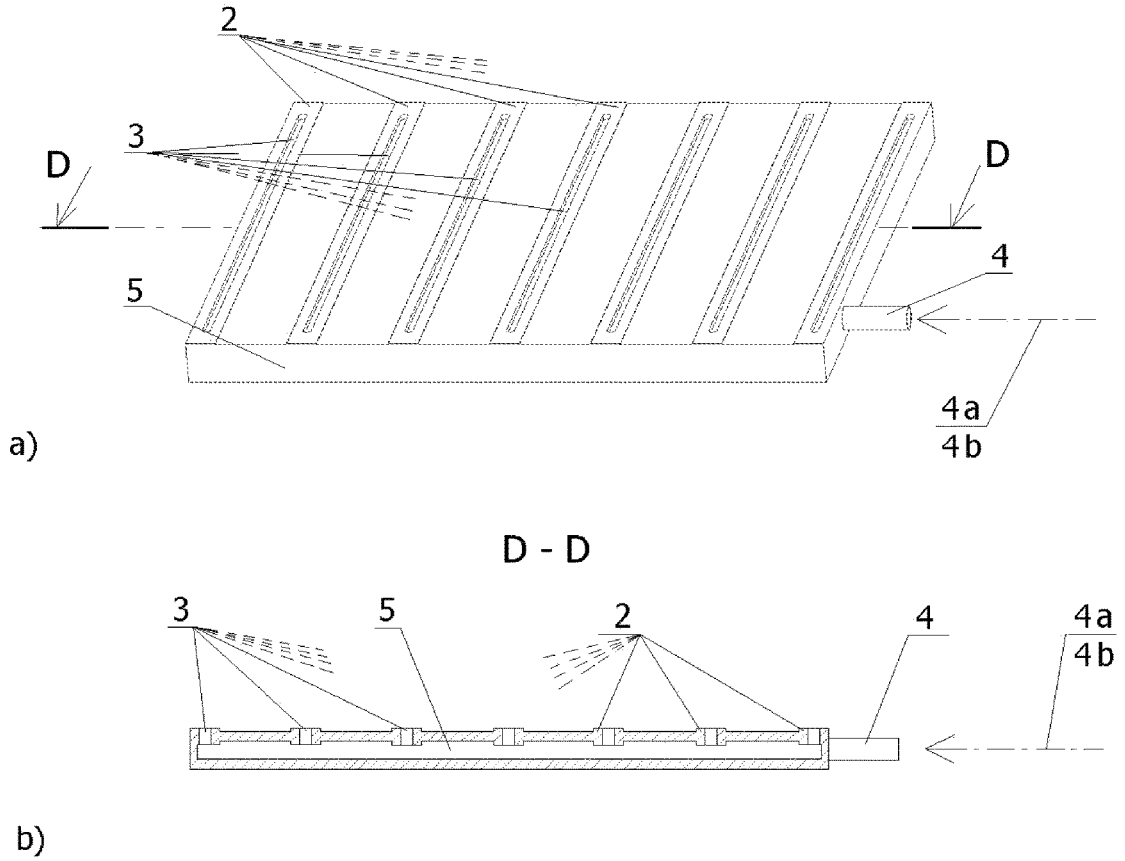
Figure 6:
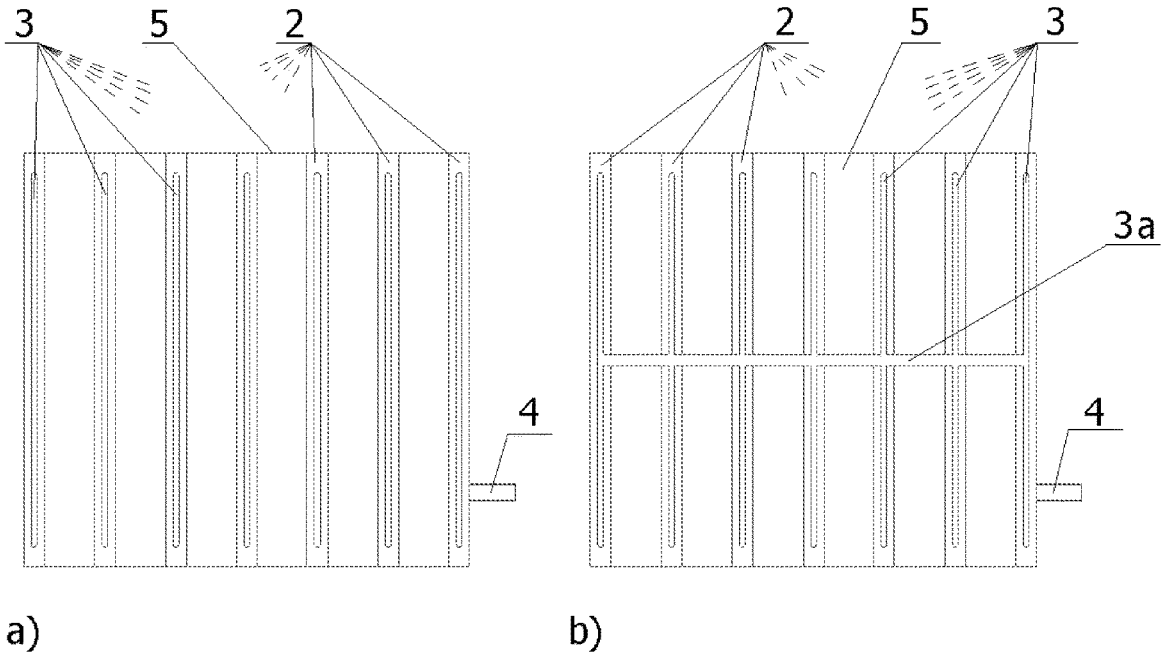

FIGS. 5*a*, 5*b* and 6*a* show a stationary solid sliding pad with multiple injection slits.

FIG. 6*b* depicts an one slit variant of the stationary solid sliding pad.

Figure 7:
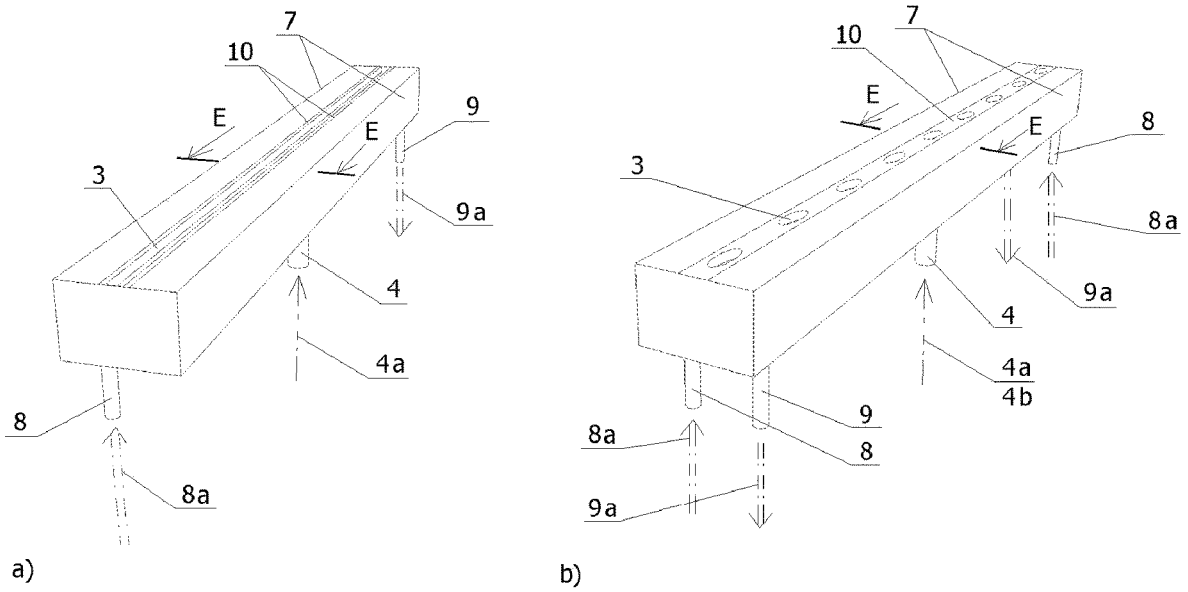

FIG. 7*a* shows a construction solution to the solid sliding pad with an injection slit with cooling. FIG. 7*b* shows a construction solution to the solid sliding pad with injection openings with cooling.

Figure 8:
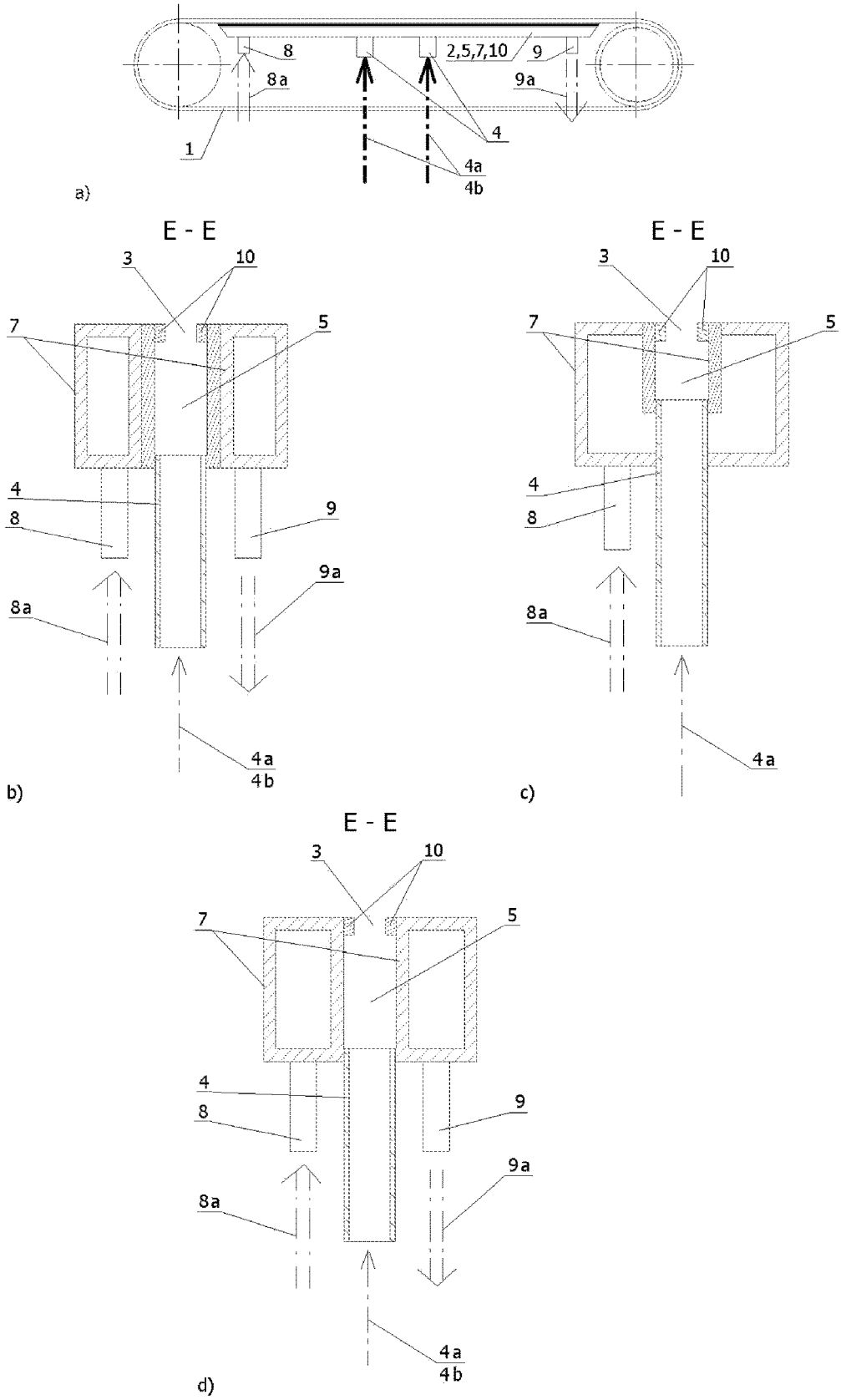

FIG. 8*a* depicts an arrangement of inlet and outlet openings of the cooling medium on hollow support beams of the stationary solid sliding pads.

FIG. 8*b* shows an arrangement of the solid sliding pad made up of two parallel support beams with the hollow profile, distribution channel serving for distribution of the compressed gas into the injection slits or the injection openings, through the inlet opening of the compressed gas and through the inlet and outlet openings for the supply of the cooling medium into the hollows and for its removal from the hollows of the support beams of the stationary solid sliding pad.

FIG. 8*c* shows an arrangement of the solid sliding pad formed by a support beam with the hollow profile featuring a distribution channel serving for distribution of the compressed gas into the injection slits or the injection openings, through the inlet opening of the compressed gas and through the inlet and outlet openings for the supply of the cooling medium into the hollows and for its removal from the hollows of the support beams of the stationary solid sliding pad.

FIG. 8*d* shows another cross-section along line E-E.

Figure 9:
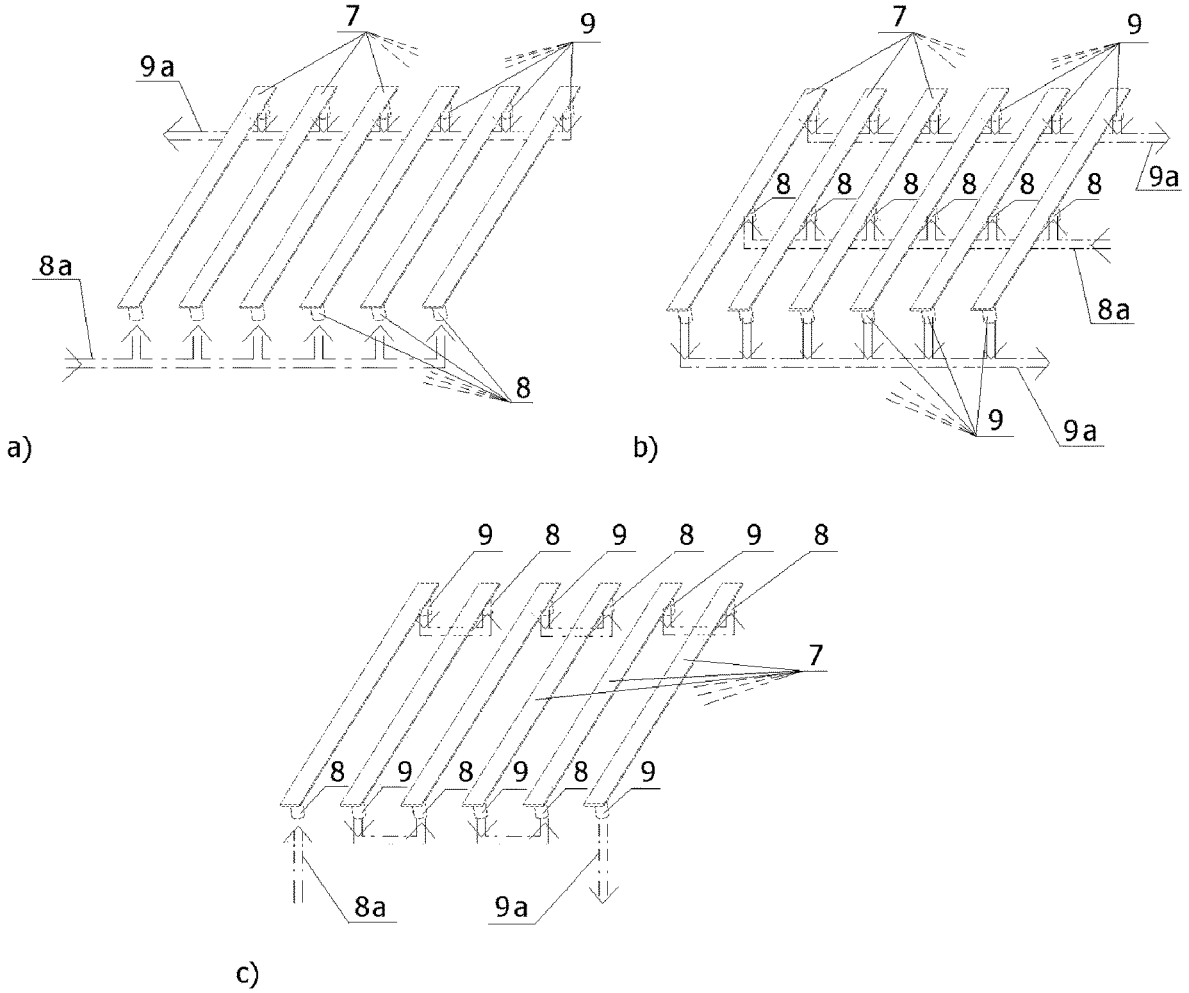

FIG. 9 shows different ways how to connect the system of stationary solid sliding pads to the source of cooling.

EXAMPLES OF IMPLEMENTATION

It is understood that individual examples of the implementation of the invention are presented to illustrate and not to limit. Using no more than routine experimentation, any knowledgeable professionals may find or be able to find a number of equivalents to the specification of the implementation of the invention, which are not explicitly described here. Such equivalents are meant to fall within the scope of the following patent claims. Any topological or kinematic modification of this kind of hockey skatemill, including necessary design, choice of materials and design layout may not be a problem, therefore these features have not been dealt with in detail. In the following examples one can find individual descriptions of different manners of implementation that use an electric motor to drive the skatemill. It is understood that in an analogous way it is possible to use any undisclosed drive unit to drive the skatemill and smoothly control its direction and speed of rotation.

Example 1

This example of a specific implementation of the invention describes a structure design of the high-speed skatemill with a movable skatemill belt 1 as depicted in the enclosed FIG. 1*a*. The high-speed skatemill consists of a movable skatemill belt that comes as the so-called endless belt with its surface fitted with a material made of artificial ice. The skatemill belt is placed on a rotating drive drum 1*b* and on a rotating driven drum 1*a* that are placed in ball bearings and on a shared support frame that is not depicted. The movable skatemill belt 1 is mounted slidably with its inner upper side touching fixed rigid sliding pads 2 with sliding surfaces which are mechanically anchored to an undisclosed common supporting frame. The stationary rigid sliding pads 2 comprise integrated distribution channels 5 whose ends are sealed and which serve to distribute the compressed gas into the injection openings 3 in the fixed rigid sliding pads 2, on which the movable skatemill belt 1 moves. The injection openings 3 are directed toward the inner side of the movable skatemill belt 1. Through the inlet openings 4 shown in FIG. 2*a*, a compressed gas 4*a* is injected into the distribution channels 5. Typically it may be compressed atmospheric air which is supplied by a compressed gas source (not shown) and which is fed into the injection openings 3 through the distribution channels 5, through which the compressed gas 4*a* penetrates into the regions between the stationary rigid sliding pads 2 and the movable skatemill belt 1 where it forms the gas bearings. The cross-section of the stationary rigid sliding pad 2 with the integrated distribution channel 5 and the injection opening 3 is in a section A-A with the inlet opening 4 supplying the compressed gas 4*a* via distribution channel 5, as shown in FIG. 3*a*.

In order to reduce the undesired friction, the anti-friction agent applicator 6*a* is included. The applicator 6 is used to apply the anti-friction medium 6*a*, as for solid substances in the form of the dispersion, sanding or coating (not shown), as for liquid substances in the form of spraying or coating (not shown), as for gaseous substances in the form of steaming or sublimation over the inner surface of the movable skatemill belt 1 while it is moving. As it is moving, the anti-friction medium 6*a* gets transported into contact areas with the stationary rigid sliding pads 2.

Figure 2:
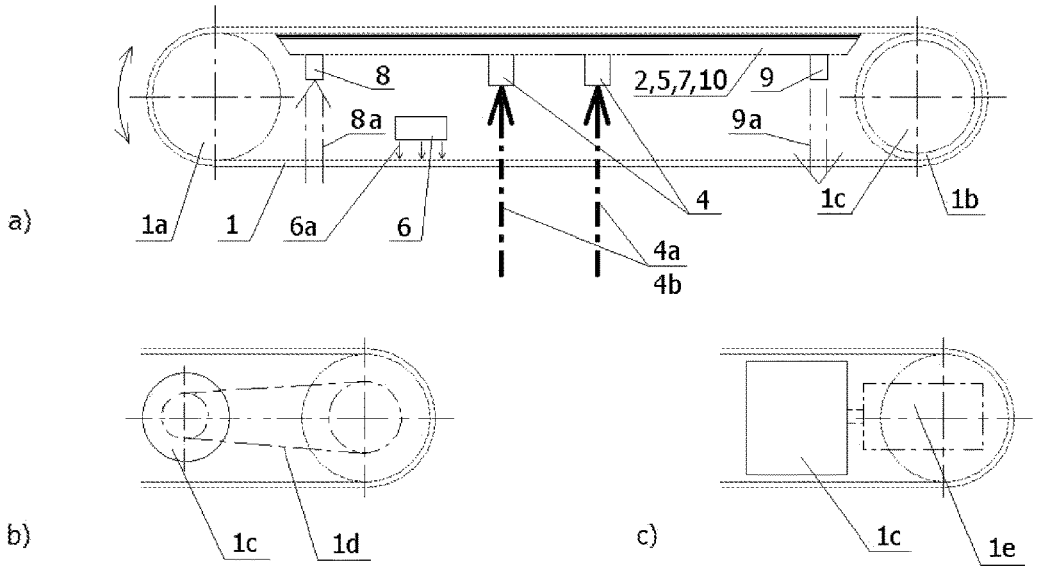

The movable skatemill belt 1 is driven by the drive electric motor 1*c*, with the transmission of the electric motor 1*c* to the driving drum 1*b* of the movable skatemill belt 1 can be carried out in several alternative ways. The first alternative illustrated in FIG. 2*a* represents a direct drive of the driving drum 1*b* of the movable skatemill belt 1 wherein the so-called drum electric motor 1*c* is directly embedded into the drive drum 1*b*. The second alternative shown in FIG. 2*b* illustrates the case where the drive electric motor 1*c* drives the drive drum 1*b* of the movable skatemill belt 1 by means of a belt or chain drive 1*d*. The third alternative in FIG. 2*c* illustrates the case where the drive electric motor 1*c* drives the drive drum 1*b* of the movable skatemill belt 1 by means of a fixed gear ratio gearbox 1*e*. The drive unit 1*c* is in all cases a 3-phase asynchronous electric motor whose direction and speed of rotation are continuously controlled by a frequency converter with a control system with actuators (not shown in FIG. 2).

Example 2

In this example of a particular arrangement of the invention, a design of a high-speed skatemill with a movable skatemill belt 1 with gas bearings is described wherein, in order to reduce undesirable friction, the injection openings 3 in the form of continuous longitudinal slits are made in the fixed rigid sliding pads 2. This technical solution is shown in the enclosed FIGS. 1*b* and 1*n* essence is sufficiently described in Example 1. FIG. 3*b* shows the cross-section of the stationary rigid sliding pad 2 with an integrated distribution channel 5 and with an injection opening 3 in the form of a continuous longitudinal slit in a Section B-B, together with an inlet opening 4 supplying the distribution channel 5 with gas 4*a*.

Example 3

In this example of a particular arrangement of the invention, a design of a high-speed skatemill with a movable skatemill belt 1 with gas bearings is described, corresponding with the arrangement shown in the enclosed FIG. 1*a*, which is in its basic features sufficiently described in Example 1. The constructional variation is in the changed arrangement of the fixed rigid sliding pads 2, without the integrated distribution channels 5. The inlet openings 4 supplying the injection openings 3 with the compressed gas 4*a* are in this case connected directly to the individual injection openings 3, as shown in FIG. 4*a*. The compressed gas 4*a* is injected directly through the inlet openings 4 into the individual injection openings 3. FIG. 4*b* shows the cross-section of the stationary rigid sliding pad 2 together with an inlet opening 4 directly supplying an injection opening 3 with the compressed gas 4*a* in a Section C-C.

Example 4

In this example of a particular arrangement of the invention, a design of a high-speed skatemill with a movable skatemill belt 1 with gas bearings is described which is in the basic features sufficiently described in Example 1 in a modification wherein the stationary rigid sliding pads 2 with injection openings and/or slits 3 are integrated with a common distribution channel 5 and together they form one mechanical unit—i.e. one immovable solid sliding pad with multiple injection slits, as described in the FIGS. 5*a*, 5*b* and 7*a*.

Example 5

In this example of a particular arrangement of the invention, a design of a high-speed skatemill with a movable skatemill belt 1 with gas bearings is described, which is in the basic features sufficiently described in Example 4 in a modification wherein the injection slits 3 are all connected to a transverse injection slit 3*a*, resulting in one injection opening with a cross section formed by cross sections of all interconnected injection openings and/or slits, as described in the FIG. 6*b*.

Example 6

In this example of a particular arrangement of the invention, a design of a high-speed skatemill with a movable skatemill belt 1 with gas bearings is described (not shown), which is in the basic features sufficiently described in Example 1 in a modification wherein the stationary rigid sliding pads 2 come in any shape, cross section, dimensions and any mutual position and are placed in any number on any random positions under the movable skatemill belt 1, and can be mechanically connected to one another in any way, distribution channels 5 come in any shape, cross section, dimensions, any mutual position, number and can be connected to any number of solid sliding pads 2 and/or to any number of injection openings and/or injection slits 3 and/or to one another, injection openings and/or injection slits 3 in the stationary solid sliding pads 2 have a random shape, size, positional (topological) arrangement and manner of manufacturing and are positioned in any number in any random positions on the sliding surfaces of the sliding pads 2, transverse injection slit 3*a* has a random shape, positional (topological) placement and orientation as to the injection openings and/or slits 3 and a manner of manufacturing, inlet openings 4 come in any shape, size, manner of manufacturing and are placed in any number on any random places of the distribution channels 5 and/or sliding pads 2 and one or more applicator of an anti-friction medium 6 come in any shape, size and manner of manufacturing and is placed in any number, in any position as to the inner area of the movable skatemill belt 1.

Example 7

In this example of a particular arrangement of the invention, a design of a high-speed skatemill with a movable skatemill belt 1 with gas bearings is described (not shown), which is in the basic features sufficiently described in Example 1 in a modification wherein the injection openings 3 are made only on some (i.e. not all) of the immovable solid sliding pads 2.

Example 8

In this example of a particular arrangement of the invention, a design of a high-speed skatemill with a movable skatemill belt 1 with gas bearings is described (not shown), which is in the basic features sufficiently described in Example 1 in a modification where in an undisclosed mixer the anti-friction medium is added to the flow of a compressed gas 4*a*, either in the form of vapors and/or aerosol and/or the dispersion containing solid dust particles or solid microparticles and creates a mixture 4*b* of the compressed gas and the anti-friction medium which gets injected into the injection openings 3 through the inlet openings 4 and through distribution channels 5 in the stationary solid sliding pads 2.

Example 9

In this example of a particular arrangement of the invention, a design of a high-speed skatemill with a movable skatemill belt 1 with gas bearings is described (not shown), which is in the basic features sufficiently described in Example 1 in a modification without the injection openings 3 and other elements serving to inject the compressed gas 4*a*, i.e. without the distribution channel 5, inlet openings 4, injected compressed gas 4*a* and without the source of the compressed gas. It comprises solely an applicator 6 that is used to apply the anti-friction medium 6*a*, as for solid substances in the form of the dispersion, sanding or coating (not shown), as for liquid substances in the form of spraying or coating (not shown), as for gaseous substances in the form of steaming or sublimation over the inner surface of the movable skatemill belt 1 while it is moving. As it is moving, the anti-friction medium 6*a* gets transported into contact areas with the stationary rigid sliding pads 2.

Example 10

In this example of a particular arrangement of the invention, a design of a high-speed skatemill with a movable skatemill belt 1 with gas bearings is described which corresponds with the realization depicted in the enclosed FIG. 1*b* which is in the basic features sufficiently described in Example 1. Its construction difference is in a modified manner of manufacturing of the immovable solid sliding pads 2 which come with a couple of parallely mounted hollow support beams 7 each, along with a distribution channel 5, uninterrupted longitudinal injection slit 3 defined on the stationary solid sliding pad by grilles 10. Upper walls of the hollow support beams 7 and a grille or grilles 10 form a single planar surface of the stationary solid sliding pad 2 on which the skatemill belt 1 runs. Cooling medium 8*a* is let into the hollows of the support beams 7 through one or more inlet openings 8 which cools down the support beams 7. After passing through the hollows of the support beams, the cooling medium 8*a* flows out through one or more outlet openings 9 as a heated cooling medium 9*a*, as described in the FIGS. 8*a* and 7*a*. Unheated cooling medium 8*a* is pushed to the hollows of the support beams, in the case of a liquid cooling medium, by an undisclosed pump or pumps and in the case of a gaseous cooling medium by a compressor or compressors and/or a fan or fans through an undisclosed supply pipeline or pipelines. Heated cooling medium 9*a* is removed through undisclosed outlet pipeline or pipelines into an undisclosed heat exchanger, in which the cooling medium gets cooled down and from there it goes into an undisclosed storage tank for the cooling medium 8*a*. Examples of a connection of the solid sliding pads (system) to the cooling source are shown in the FIGS. 9*a*-9*c*. In the case of the alternatives shown in the FIGS. 9*a* and 9*b*, the solid sliding pads are fed in parallel by the cooling medium, i.e. all the inlet openings of the cooling medium 8 on all the hollow support beams 7 of the solid sliding pads 2 are connected to the common supply pipeline and all the outlet openings of the cooling medium 9 from all the hollow support beams 7 of the solid sliding pads 2 are connected to the common outlet pipeline. In the case of the alternative shown in the FIG. 9*c*, the hollow support beams 7 in the individual solid sliding pads are connected in series, i.e. the outlet opening of the cooling medium 9 of one hollow support beam is connected to the inlet opening of the cooling medium 8 on the other hollow support beam—with an exception of the inlet opening of the cooling medium 8 that is connected to the supply pipeline and outlet opening 9 connected to the outlet pipeline of the cooling medium. The cross-section of the stationary solid sliding pad 2 comprising a couple of parallely mounted hollow support beams 7, with a distribution channel 5, an injection opening 3 in form of an uninterrupted longitudinal slit, with an inlet opening 4 supplying the distribution channel 5 with gas 4*a*, and with an inlet opening 8 of the cooling medium 8*a* and with an outlet opening 9 of the heated cooling medium 9*a* in the E-E section is shown in the FIG. 8*b*.

Example 11

In this example of a particular arrangement of the invention, a design of a high-speed skatemill with a movable skatemill belt 1 with gas bearings is described which corresponds with the realization depicted in the enclosed FIG. 1*b* which is in the basic features sufficiently described in Example 10. Its construction difference is in a modified manner of manufacturing of the immovable solid sliding pads 2 wherein each stationary solid sliding pad 2 consists of a hollow support beam 7 featuring an inbuilt distribution channel 5, as shown in the E-E section in the FIG. 8*c*.

Example 12

In this example of a particular arrangement of the invention, a design of a high-speed skatemill with a movable skatemill belt 1 with gas bearings is described which corresponds with the realization depicted in the enclosed FIG. 1*b* which is in the basic features sufficiently described in Example 10. Its construction difference is in a modified manner of manufacturing of the immovable solid sliding pads 2 wherein the side walls of the distribution channel 5 are shared with the side walls of the hollow support beams 7, as shown in the E-E section in the FIG. 8*d*.

Example 13

In this example of a particular arrangement of the invention, a design of a high-speed skatemill with a movable skatemill belt 1 with gas bearings is described which corresponds with the realization depicted in the enclosed FIG. 1*a* which is in the basic features sufficiently described in Examples 10-12. Its construction difference is in a modification wherein the grilles 10 of the immovable solid sliding pads 2 feature injection openings 3 rather than uninterrupted injection slits.

Example 14

In this example of a particular arrangement of the invention, a design of a high-speed skatemill with a movable skatemill belt 1 with gas bearings is described (not shown) which is in the basic features sufficiently described in Examples 10-13. Its construction difference is in a modification wherein the cooling medium used to cool down the support beams 7 of the stationary solid sliding pads 2 is atmospheric air that is pushed by an undisclosed fan or fans through the inlet opening 8 an/or through an undisclosed pipeline or pipelines into the hollows of the support beams 7 and that gets removed from the hollows of the support beams 7 through the outlet openings 9 and/or through an undisclosed outlet pipeline or pipelines.

Example 15

In this example of a particular arrangement of the invention, a design of a high-speed skatemill with a movable skatemill belt 1 with gas bearings is described which is in the basic features sufficiently described in Examples 4 and 5. Its construction difference is in a modification wherein the stationary solid sliding pads 2 integrated in a common distribution channel 5 are manufactured in one of the ways shown in the examples 10-13.

Example 16

In this example of a particular arrangement of the invention, a design of a high-speed skatemill with a movable skatemill belt 1 with gas bearings is described which is in the basic features sufficiently described in Examples 10 through 13 in a modification wherein the support beams 7 feature walls of any thickness, the hollows in the support beams 7 come in any shape, cross section, dimensions, number and in the case that there is more than one hollow then the hollows can be in any mutual position, inlet openings 8 and outlet openings 9 on the support beams 7 come in any number and in any random positions, any shape, cross section and any mutual position and each inlet opening 8 and outlet opening 9 can be connected with any number of the hollows in the support beam 7, grilles 10 defining the injection slits and injection openings 3 come in any dimensions, shape and any number of grilles may be used to make injection slits and injection openings.

INDUSTRIAL APPLICATION

The high-speed skatemill with the movable skatemill belt with gas bearings, according to the invention, is intended in particular for individual training and performance testing of athletes who perform sports activities on the ice surface and who use skates to perform sports activities.

The invention claimed is:

1. A high-speed skatemill with a movable skatemill belt, wherein the movable skatemill belt is tensioned between two rotating support drums, that are mounted on a common support frame in rolling bearings, wherein at least one of the two rotating support drums is connected to a driving unit and the movable skatemill belt is mounted slidably with its inner side on at least one stationary rigid sliding pad, wherein the at least one stationary rigid sliding pad comprises a plurality of spaced, unobstructed, gas outlet openings directed towards the inner side of the movable skatemill belt and connected directly or through a distribution channel to at least one gas or gas mixture inlet opening.

2. The high-speed skatemill of claim 1, further comprising at least one applicator with a solid or liquid anti-friction medium outlet directed towards the inner side of the movable skatemill belt.

3. The high-speed skatemill of claim 2, wherein the solid anti-friction medium comprises solid dust particles or solid microparticles.

4. The high-speed skatemill of claim 2, wherein the at least one stationary rigid sliding pad comprises at least one hollow connected to at least one inlet opening and at least one outlet opening of liquid and/or gas cooling medium.

5. The high-speed skatemill of claim 1, wherein the at least one gas or gas mixture inlet opening is also connected to an outlet opening of a mixer containing a secondary inlet opening of gas or gas mixture and a secondary inlet opening of a solid or liquid anti-friction medium.

6. The high-speed skatemill of claim 1, wherein the at least one stationary rigid sliding pad comprises at least one hollow connected to at least one inlet opening and at least one outlet opening of liquid and/or gas cooling medium.

7. A high-speed skatemill with a movable skatemill belt, wherein the movable skatemill belt is tensioned between two rotating support drums, that are mounted on a common support frame in rolling bearings, wherein at least one of the two rotating support drums is connected to a driving unit and the movable skatemill belt is mounted slidably with its inner side on at least one stationary rigid sliding pad, wherein the at least one stationary rigid sliding pad comprises at least one gas outlet slit, directed towards the inner side of the movable skatemill belt and the at least one gas outlet slit in the at least one stationary rigid sliding pad is connected directly or through a distribution channel to at least one gas or gas mixture inlet opening.

8. The high-speed skatemill of claim 7, further comprising at least one applicator with a solid or liquid anti-friction medium outlet directed towards the inner side of the movable skatemill belt.

9. The high-speed skatemill of claim 8, wherein the solid anti-friction medium comprises solid dust particles or solid microparticles.

10. The high-speed skatemill of claim 8, wherein the at least one stationary rigid sliding pad comprises at least one hollow connected to at least one inlet opening and at least one outlet opening of liquid and/or gas cooling medium.

11. The high-speed skatemill of claim 7, wherein the at least one gas or gas mixture inlet opening is also connected to an outlet opening of a mixer containing a secondary inlet opening of gas or gas mixture and a secondary inlet opening of a solid or liquid anti-friction medium.

12. The high-speed skatemill of claim 7, wherein the at least one stationary rigid sliding pad comprises at least one hollow connected to at least one inlet opening and at least one outlet opening of liquid and/or gas cooling medium.

13. A high-speed skatemill with a movable skatemill belt, wherein the movable skatemill belt is tensioned between two rotating support drums, that are mounted on a common support frame in rolling bearings, wherein at least one of the two rotating support drums is connected to a driving unit and the movable skatemill belt is mounted slidably with its inner side on at least one stationary rigid sliding pad, and further comprising at least one applicator with a solid or liquid anti-friction medium outlet directed towards the inner side of the movable skatemill belt.

14. The high-speed skatemill of claim 13, wherein the solid anti-friction medium comprises solid dust particles or solid microparticles.

15. The high-speed skatemill of claim 13, wherein the at least one stationary rigid sliding pad comprises at least one hollow connected to at least one inlet opening and at least one outlet opening of liquid and/or gas cooling medium.

* * * * *